United States Patent [19]

Hasenack

[11] Patent Number: 4,491,271

[45] Date of Patent: Jan. 1, 1985

[54] PROCESS AND APPARATUS FOR MIXING FLUIDS

[75] Inventor: Hendrikus J. A. Hasenack, Geldermalsen, Netherlands

[73] Assignee: Shell Oil Company, Houston, Tex.

[21] Appl. No.: 563,880

[22] Filed: Dec. 20, 1983

Related U.S. Application Data

[63] Continuation of Ser. No. 233,265, Feb. 10, 1981, abandoned.

[51] Int. Cl.[3] ..... B05B 1/14

[52] U.S. Cl. ..... 239/1; 239/432; 239/567

[58] Field of Search ..... 239/1, 8, 11, 418, 419.3, 239/422, 424.5, 425, 428, 429, 432, 543, 544, 599, 548, 567

[56] References Cited

U.S. PATENT DOCUMENTS

| | | | |
|---|---|---|---|
| 2,072,375 | 3/1937 | McCallum | 239/8 |
| 2,933,259 | 4/1960 | Raskin | 239/405 |
| 3,589,603 | 6/1971 | Fohl | 239/1 |
| 4,002,293 | 1/1977 | Pillard | 239/432 |
| 4,139,158 | 2/1979 | Uchida | 235/567 |
| 4,141,505 | 2/1979 | Reich | 239/431 |

*Primary Examiner*—James B. Marbert

*Attorney, Agent, or Firm*—Albert J. Adamcik

[57] ABSTRACT

An atomizer and method of atomization featuring prevention of spray collapse by use of critical spacing of atomizer features is disclosed.

7 Claims, 2 Drawing Figures

FIG. 1
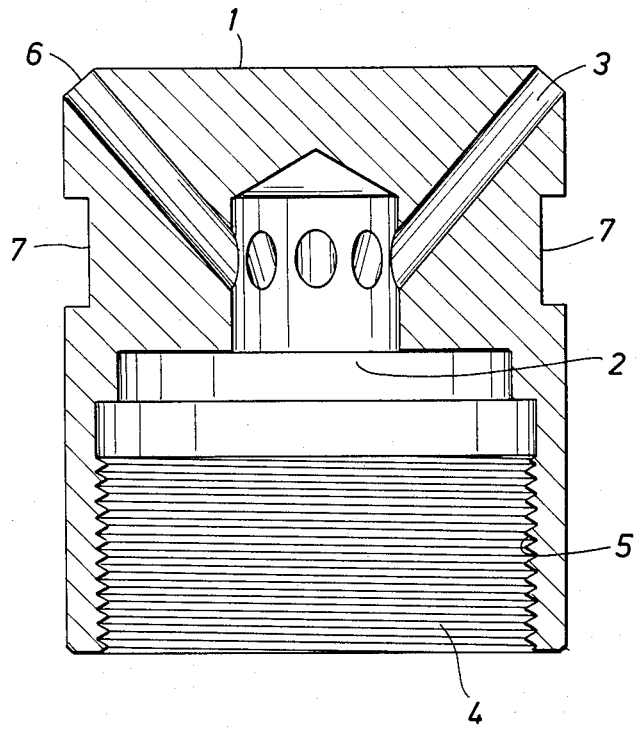
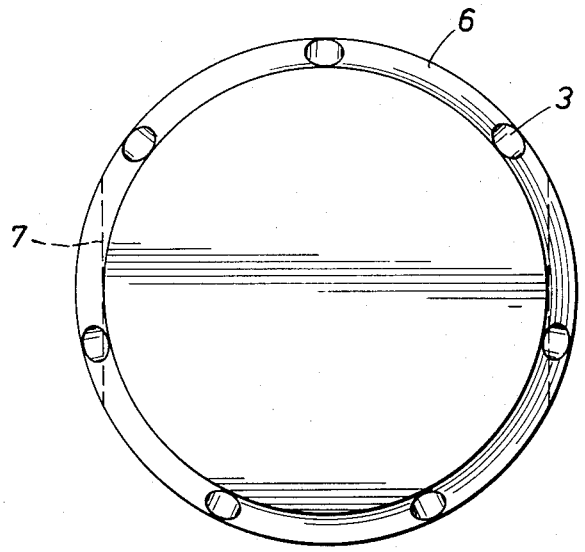
FIG. 2

PROCESS AND APPARATUS FOR MIXING FLUIDS

This is a continuation of application Ser. No. 233,265, filed Feb. 10, 1981, now abandoned.

BACKGROUND OF THE INVENTION

Many internal mix atomizers are designed so that critical two phase flow occurs at the exits of the atomization ports or orifices. Thus, the pressure at the exits of the ports is higher than ambient pressure. Accordingly, the spray jets will expand outside the atomizer to a much larger diameter than that of the ports. To a point, an increase in either liquid flow or atomizing fluid flow or both will result in a higher pressure in the internal mixing chamber and through the exits of the ports, and a larger jet spray will result.

In the case where the distance between two neighboring atomization ports is too small, the expanded jets can get too close together and collapse of the jets will result. Again, a set of sprays may collapse because the number of ports is too great. This first type of collapse phenomenon is to be distinguished from collapse of the jet sprays when the jet sprays are coming in contact at larger distances, e.g., a foot or so, downstream from the atomizer. External factors influencing this second type of collapse of the jet sprays include the crossflow of other fluids or presence of other bodies close to the atomizer. Accordingly, an atomizer design that minimizes or eliminates the first type of collapse of the spray jets would have great utility. The invention relates to such a design.

SUMMARY OF THE INVENTION

Accordingly, the invention comprises, in one aspect, an atomizer structure particularly suited for elimination of spray collapse of the first type described at high liquid/fluid throughput. In particular, the atomizer of the invention is eminently suited for atomizing heavy liquids, such as heavy residues, for combustion in burners for a wide variety of purposes.

In another aspect, the invention comprises a process for the atomization of a heavy liquid in which the heavy liquid, possibly diluted and/or at elevated temperature and pressure, is supplied along with an atomizing fluid under pressure to the mixing chamber of an internal mix atomizer having a plurality of ports communicating through hollow passages with the mixing chamber, the ports being spaced from each other on the exterior of the atomizer according to the critical relationship described herein. In yet another aspect, a heavy combustible liquid is combusted utilizing the concepts described herein.

DETAILED DESCRIPTION OF THE INVENTION

As indicated, the atomizer of the invention is an internal mix atomizer designed for high liquid/fluid throughput. The invention is particularly useful where liquid throughputs are high, say on the order of 5000 to 8000 lbs/hr.

Any suitable heavy liquid may be utilized. In general, suitable liquids should have a kinematic viscosity, when supplied to the atomizer, equal to or less than about 20 centistokes. Such a value may be arrived at by elevation of the temperature of the liquid or by dilution with a lighter liquid, or both, as will be recognized by those skilled in the art. Useful liquids, for example, for combusting as a fuel, are those having a carbon/hydrogen weight ratio equal to or greater than 10 and a kinematic viscosity (at 70° F.) greater than 300 centistokes.

If a diluent is employed, any suitable volume, e.g., from 0 percent to 50 percent by volume, preferably 0 percent to 25 percent by volume, may be used. Again, any suitable or conventional diluent may be used. In the case of heavy residues, for example, gas oil may be used. Similarly, any suitable atomizing medium may be used. Particularly preferred, in the case of heavy liquids, such as residual oils or pyrolysis pitch, are steam or methane. As will be understood by those skilled in the art, the atomizing medium may be utilized at a wide variety of pressures and temperatures. For example, steam at 600° F. and 600 P.S.I.G. may be employed for some of the heavier liquids. As indicated, to assist flowability, the temperature of the heavy liquid may also be elevated by heating, e.g., up to 500° F.

With these considerations in mind, it has been found, that, for a given heavy liquid flow, atomizing fluid flow, and geometric configuration of atomization ports of potentially unequal size, a critical equivalent pitch circle diameter exists for which no spray collapse will take place. The determining parameters for the spray collapse involved are:

The heavy liquid flow for each port j, $\dot{m}_{oj}$

The atomizing fluid flow for each port j, $\dot{m}_{vj}$

The momentum flow for each port j, $\dot{g}_j$

The number of atomization ports, n

The equivalent pitch circle diameter, $D_e$

For these purposes, the equivalent pitch circle diameter is defined as the quantity 4A/P where A is the enclosed area formed by joining the centers of adjacent exit ports with straight line segments and P is the perimeter of the enclosed area A.

With an approximate approach it is possible to determine the critical relation between the size of the individual spray jets, the equivalent pitch circle diameter, and the number of atomization ports. In order to prevent spray collapse of the first type mentioned, it is necessary that the fraction of the distance between adjacent exit ports that is occupied by the associated spray jets directly after expansion be smaller than a critical value $\alpha$, or, in equivalent terms, $$\frac{r_i(0) + r_j(0)}{t_{ij}} < \alpha \text{ for all pairs of adjacent exit ports } (i \neq j)$$

where $r_i(0)$ and $r_j(0)$ are the jet radi directly after expansion of exit ports i and j, respectively, and $t_{ij}$ is the distance between the center of exit port i and the center of exit port j. The critical value of $\alpha$ is smaller than 1, generally less than about 0.8. The jet radius after expansion for exit hole j can be found when accepting the following assumptions:

The spray jets expand instantaneously downstream of the nozzle exit.

Droplet and gas velocities are identical after expansion.

The atomizing fluid temperature or density will be determined by saturated conditions at ambient pressure. No condensation of the fluid due to the expansion will occur. Heat transfer between the droplets and the vapor under these conditions is so fast that this assumption is reasonable for hot liquids. If cold heavy liquids are used, this assumption is not valid.

The vapor velocity after expansion is now given by:

$$u_{vj} = u_{oj} = \frac{\dot{g}_j}{(\dot{m}_{oj} + \dot{m}_{vj})}$$

The jet radius after expansion is given by:

$$r_j(0) = \left( \frac{\dot{m}_{vj}}{\pi \rho_v u_{vj}} \right)^{\frac{1}{2}}$$

($\rho_v = 0.6$ kg/m$^3$ at ambient pressure)

Accordingly, the critical relation can be rewritten in terms of the liquid flow, atomizing fluid ratio and momentum flow for adjacent ports and the distance between ports:

$$\dot{m}_{oi} \left[ \frac{\dot{m}_{vi}}{\dot{m}_{oi}} \left( 1 + \frac{\dot{m}_{vi}}{\dot{m}_{oi}} \right) / \dot{g}_i \right]^{\frac{1}{2}} + \dot{m}_{oj} \left[ \frac{\dot{m}_{vj}}{\dot{m}_{oj}} \left( 1 + \frac{\dot{m}_{vj}}{\dot{m}_{oj}} \right) / \dot{g}_j \right]^{\frac{1}{2}} < \alpha (\pi \rho_v)^{\frac{1}{2}} t_{ij}$$

where $\alpha$=constant less than about 0.8.

For the case of a circular array of equally spaced exit ports of equal size the equivalent pitch circle diameter is in fact the pitch circle diameter D and the pitch diameter and the number of atomization ports are related by the expression t=D sin (180°/n) where t is the distance between adjacent ports. For this case, the critical pitch circle diameter, as a function of number of ports, liquid flow and atomizing fluid ratio can now be given by:

$$\frac{2\,\dot{m}_o \left[ \frac{\dot{m}_v}{\dot{m}_o} \left( 1 + \frac{\dot{m}_v}{\dot{m}_o} \right) / (\pi \rho_v \dot{g}) \right]^{\frac{1}{2}}}{D \sin (180°/n)} < \alpha$$

where $\alpha$=less than about 0.8.

Accordingly, design of the atomizer of the invention so that the pitch circle diameter is less than the mentioned value allows operation without fear of the type of jet spray collapse described. In the case where the atomizer is employed as a component of a burner, the utilization of the invention, say with diluted pyrolysis pitch, excess air, e.g., about 8 to 15 percent by volume, and steam, results in an effective burn with low particulates emissions.

In order to describe the invention more fully, reference is made to the accompanying drawing. FIG. 1 thereof illustrates a cross section of an embodiment of the invention, while FIG. 2 represents a top view of the same embodiment.

More particularly, as shown in both figures, integrally constructed (optional) atomizer 1 is an internal mix atomizer characterized by a mixing chamber 2 communicating with a plurality of passages 3 (preferably cylindrical). Chamber 2 is adapted by opening 4 and threads 5 for communication and connection with a fluid supply source (not shown). Passages are positioned in member 1 in accordance with the principles described herein, that is, they are spaced so that the relationship discussed, supra, is observed and the critical pitch diameter with respect to the terminal ports 6 of passages 3 is observed. Means may be provided, such as slots 7, for anchoring the atomizer in place in, for example, a burner or liquid contactor.

In operation, a liquid and a fluid employed for atomization of the liquid are introduced under pressure into mixer chamber 2 via a source, such as a supply tube or tubes (not shown). The liquid and fluids may or may not be mixed prior to entry into chamber 2. The mixed fluids are forced through passages 3, and through ports 6 where they expand beacuse of reduction in pressure. Ports 6 are preferably circular in shape, and are preferably, as shown, at an angle to the exterior surfaces of atomizer 1. Preferably, atomizer 1 (and atomizers according to the invention) will be of roughly cylindrical shape, although other shapes are permissible. In general, the ports are spaced around the periphery of the atomizer at a location somewhat disposed from the liquid supply—fluid supply opening. For example, if the atomizer is generally cylyndrical, as illustrated in the embodiment of the drawing, the ports may be spaced, in accordance with the relationship described herein, in the side of a frustoconical section whose smaller base is the "base" of the "cylinder" opposite the liquid-fluid supply opening of the atomizer, the side of the frustoconical section terminating at the "cylinder" sides or wall.

As indicated, although not shown, atomizer 1 is eminently adapted for inclusion with suitable burner or contacting structure.

In order to illustrate the invention, the following procedure was carried out utilizing an atomizer according to the invention. The following input and design data were used:

number of ports, n—7
pitch circle diameter, D—56 mm
total atomization angle—85°
$d_j(0)/t_n$=0.73

In this procedure the atomizer of the invention was employed in a burner, the liquid being atomized was pyrolysis pitch, the diluent was gas oil (20 percent by weight) and the fluidizing medium was steam at about 650 P.S.I.G. The mass ratio of steam to pitch/gas oil was 0.4. The following table, Table 1, shows the composition and properties of the pitch, gas oil mixture:

TABLE 1

| Composition of Test Mixture | |
|---|---|
| 80% w | Pyrolysis Pitch |
| 20% w | Pyrolysis Light Gas-Oil |
| Carbon | 92.8% w |
| Hydrogen | 6.93% w |
| Sulfur | 0.13% w |
| Nitrogen | 130–260 ppmw |
| Oxygen | 0.14% w |
| Total | 100% w |
| Conradson Carbon Residue: | 24% w |
| Viscosity at 212° F. | 55 cS |
| Higher Heating Value | 17,400 Btu/lb |
| Specific Gravity at 70° C. | 1.10 |

The mixture was supplied at a rate of about 7000 lbs/hr., and was fired at 270° F., which corresponds to a 17 cS viscosity. The burn was carried out with the atomizer mounted in a front fired boiler utilizing 8 to 15 percent by volume excess air, steam being premixed with the pitch/gas oil mixture. The atomizer produced a good flame with 7 independent flame fingers. The flames were short in comparison with firebox depth.

What is claimed is:

1. An internal mix atomizer comprising a member having an internal mixing chamber adapted to receive a liquid and fluid supply, a plurality of interior passages each communicating, at one end thereof, with the mixing chamber and each terminating, at the other end thereof, as an exit port in the surface of the atomizer, the passages being located in the atomizer so that the exit ports are positioned in relation to each other in such manner that the ratio $$\frac{r_i(0) + r_j(0)}{t_{ij}},$$

where $r_i(0)$ and $r_j(0)$ are jet radii directly after expansion of exit ports i and j, respectively, $t_{ij}$ is the distance between the center of port i and the center of exit port j, is less than about 0.8.

2. A process for the atomization of a heavy liquid comprising, passing a heavy liquid, at elevated temperature and pressure, and an atomizing fluid under pressure to the mixing chamber of an internal mix atomizer having a plurality of interior passages each communicating, at one end thereof, with said chamber, said passages each terminating, at the other end thereof, as ports on the exterior of the atomizer, the passages being located in the atomizer so that the exit ports are positioned in relation to each other in such manner that the ratio $$\frac{r_i(0) + r_j(0)}{t_{ij}},$$

where $r_i(0)$ and $r_j(0)$ are jet radii directly after expansion of exit ports i and j, respectively, $t_{ij}$ is the distance between the center of port i and the center of exit port j, is less than about 0.8.

3. A process comprising, passing, at elevated temperature, a heavy combustible liquid and an atomizing fluid to the mixing chamber of an internal mix atomizer, said atomizer having a plurality of interior passages each communicating, at one end thereof, with said chamber, said passages terminating, at the other end thereof, as ports on the exterior of the atomizer, the passages being located in the atomizer so that the exit ports are positioned in relation to each other in such manner that the ratio $$\frac{r_i(0) + r_j(0)}{t_{ij}},$$

where $r_i(0)$ and $r_j(0)$ are jet radii directly after expansion of exit ports i and j, respectively, $t_{ij}$ is the distance between the center of port i and the center of exit port j, is less than about 0.8, providing air, in stoichiometric excess, in the vicinity of the ports of said atomizer, to produce a combustible atomized mixture, and combusting said mixture.

4. The process of claim 3 wherein the heavy combustible liquid contains 0 percent to 50 percent of a diluent.

5. A process comprising, passing a diluted heavy combustible liquid and an atomizing fluid to the mixing chamber of an internal mix atomizer, said atomizer having a plurality of interior passages each communicating, at one end thereof, with said chamber, said passages terminating, at the other end thereof, as ports on the exterior of the atomizer, the passages being located in the atomizer so that the exit ports are positioned in relation to each other in such manner that the ratio $$\frac{r_i(0) + r_j(0)}{t_{ij}},$$

where $r_i(0)$ and $r_j(0)$ are jet radii directly after expansion of exit ports i and j, respectively, $t_{ij}$ is the distance between the center of port i and the center of exit port j, is less than about 0.8, providing air, in stoichiometric excess, in the vicinity of the ports of said atomizer, to produce a combustible atomized liquid-air mixture, and combusting said mixture.

6. The process of claim 5 wherein the heavy combustible liquid contains up to about 50 percent by volume of the diluent.

7. The process of claim 5 wherein the heavy combustible liquid contains up to about 25 percent by volume of the diluent.

* * * * *